US005791870A

United States Patent [19]

Alexander

[11] Patent Number: 5,791,870

[45] Date of Patent: Aug. 11, 1998

[54] BLOWER HAVING REVERSIBLE CONNECTING FLANGE

[75] Inventor: Robert H. Alexander, Bloomfield, Conn.

[73] Assignee: The Spencer Turbine Company, Windsor, Conn.

[21] Appl. No.: 791,184

[22] Filed: Jan. 31, 1997

[51] Int. Cl.[6] ..... F04D 29/66

[52] U.S. Cl. ..... 415/119; 285/124.1; 285/124.3; 285/124.4; 285/148.19

[58] Field of Search ..... 415/119; 285/124.1, 285/124.2, 124.3, 124.4, 148.19

[56] References Cited

U.S. PATENT DOCUMENTS

| | | | |
|---|---|---|---|
| 4,089,549 | 5/1978 | Vyse et al. | 285/124.4 |
| 4,412,781 | 11/1983 | Abe et al. | 415/119 |
| 4,754,993 | 7/1988 | Kraynick | 285/124.4 |
| 5,201,552 | 4/1993 | Hohmann et al. | 285/124.4 |

*Primary Examiner*—John T. Kwon
*Attorney, Agent, or Firm*—McCormick, Paulding & Huber

[57] ABSTRACT

A regenerative blower having an impeller casing and an integral silencer casing separated from the impeller casing by a dividing wall. The impeller casing cooperates with a rotary impeller to define a generally annular fluid chamber having opposite end portions terminating at fluid inlet and outlet openings in the dividing wall opening into the silencer casing. Resilient compressible acoustic material contained within the silencer casing defines inlets and outlets fluid passageways respectively communicating with the inlet and outlet openings. A reversible flange plate forms a closure for the silencer casing. A first set of conduit fittings project from one side of the plate and a second of conduit fittings project from the opposite side of the plate and communicating with the first set through the plate. The first set of fittings is adapted for connection to threaded pipe. The fittings of the second set provide tubing or hose connections. The flange plate may be reversed relative to the silencer casing to expose a selected one of the sets of fittings externally of the silencer casing. The fittings of the other set are disposed within the silencer casing in pressing engagement with the resilient compressible acoustic material and establish communication with the inlet and outlet passageways defined by the acoustic material.

15 Claims, 2 Drawing Sheets

BLOWER HAVING REVERSIBLE CONNECTING FLANGE

BACKGROUND OF THE INVENTION

This invention relates in general to blowers and deals more particularly with improvements in a blower of the type having a removable connecting flange including an inlet or suction conduit fitting and an outlet or discharge conduit fitting for connecting the blower in an associated system. Such blowers may be used to either generate pressure or produce vacuum and are used for a wide variety of applications in many and varied industries.

A few examples of the varied applications for such blowers include power pneumatic conveying and cushioning, liquid agitating, sausage casing stripping, aquaculture aerating, sand and shot blasting, vacuum holding, fuel atomizing, sewage screen cleaning and clean room air extraction. It should be apparent that the versatility of such a blower dictates that more than one type of connecting fittings must be available to adapt a blower to the requirements of the potential purchaser. In some instances, for example, the requirements of a particular system may dictate that a blower for use with the system be connected to the system by threaded pipe. In other instances, tubing or hose may be employed as a fluid conduit. These varied and diverse system connection requirements make it necessary for the blower manufacturer to produce a plurality of connecting flanges for each blower produced. These connection requirements also impose burdensome inventory problems for the blower distributor who must be prepared to promptly satisfy varying customer demands.

Accordingly, it is the general aim of the present invention to provide an improved blower to reduce the manufacturing and inventory requirements imposed by the varied and diverse usages of the blower.

SUMMARY OF THE INVENTION

In accordance with the present invention there is provided an improved blower of the type having a casing including means for defining a fluid passageway therein, a flange releasably secured to the casing and having porting means defining a suction port and a discharge port for communicating with fluid passageway and with each other through the fluid passageway, and an impeller supported to rotate within the casing for moving fluid through the passageway between the suction port and the discharge port.

In accordance with the present invention, the releasable flange is reversible relative to the casing and the porting means comprises a first pair of conduit fittings axially projecting form a first side of the flange and a second set of conduit axially projecting from a second side of the flange opposite the first side. The first set of fittings includes a first inlet conduit fitting and first outlet conduit fitting whereas the second set of fittings includes a second inlet conduit fitting and a second outlet conduit fitting. The conduit fittings in the first set are adapted for connection to one type of fluid conduit whereas the conduit fittings in the second set are adapted for connection to a fluid conduit of another type.

DETAILED DESCRIPTION OF PREFERRED EMBODIMENT

Figure 1:
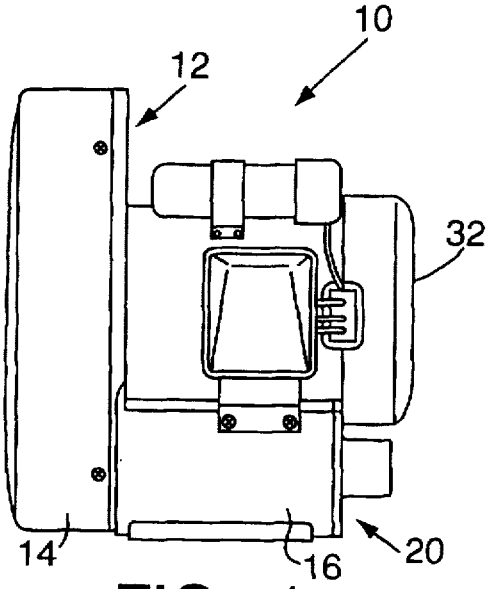
FIG. 1 is a side elevational view of a regenerative blower embodying the present invention.
Figure 2:
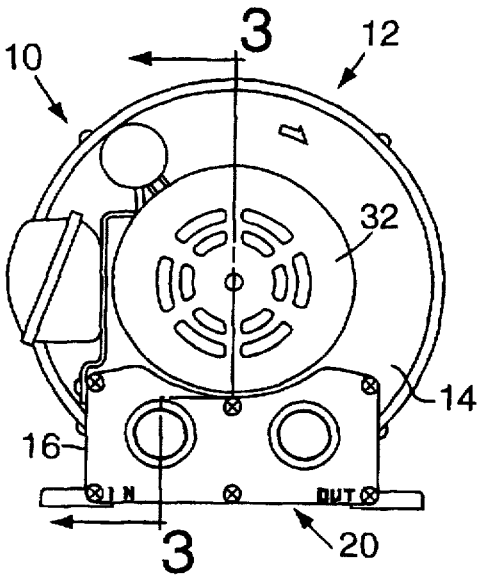
FIG. 2 is an end elevational view of the blower shown in FIG. 1.
Figure 3:
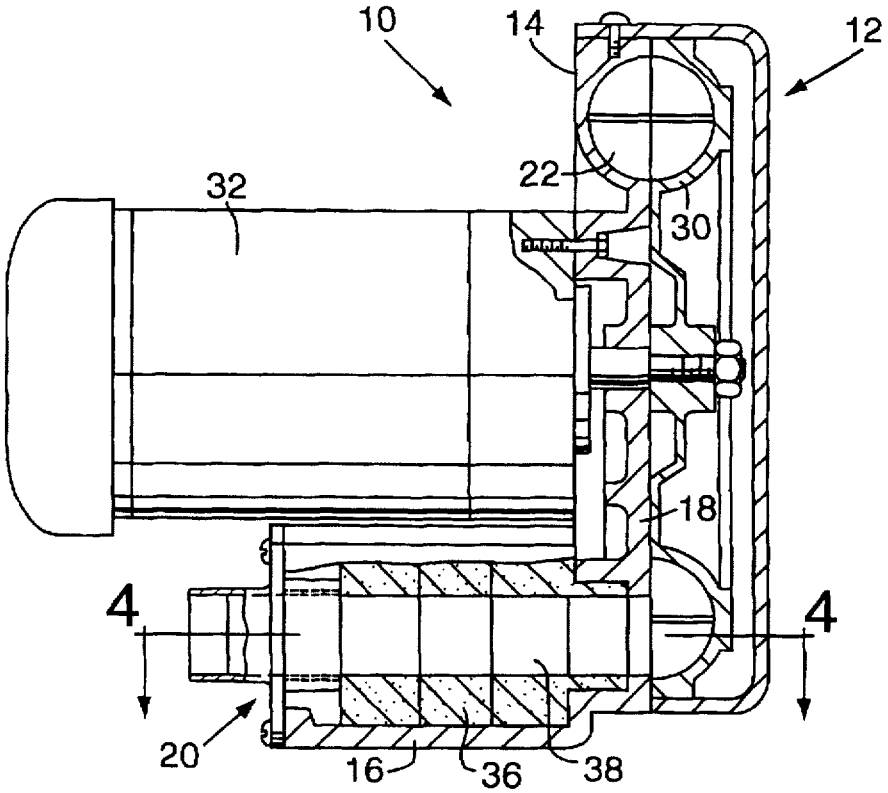
FIG. 3 is a somewhat enlarged side elevational view of the blower shown partially in section taken generally along the line 3—3 of FIG. 2.
Figure 4:
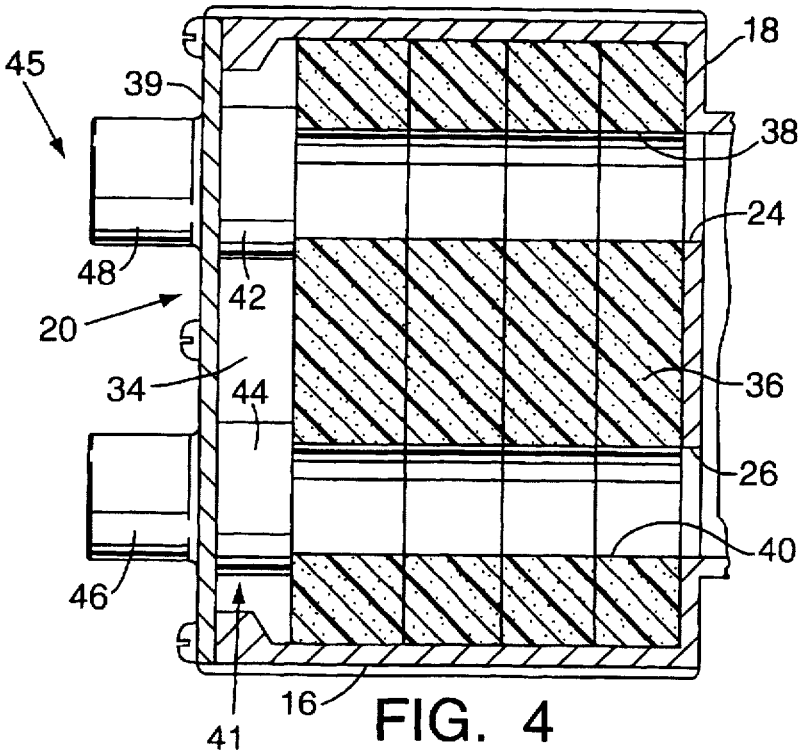
FIG. 4 is a fragmentary sectional view taken along the line 4—4 of FIG. 2.

In the drawing and in the description which follows the present invention is illustrated and described with reference to a single stage regenerative blower of a well known type indicated generally by the reference numeral 10 and designed to create pressure through the controlled used of centrifugal force. The illustrated blower 10 is adapted for connection to an associated apparatus or system to generate pressure or produce vacuum, as required, and essentially comprises a casing assembly indicated generally at 12 which includes an impeller casing 14, and a silencer casing 16 which, as shown, comprises an integral part of the impeller casing. A partition or dividing wall 18 separates the impeller casing 14 from the silencer casing 16, substantially as shown in FIGS. 3 and 4 of the drawings. The casing assembly 12 further includes a reversible connecting flange, indicated generally at 20 and which comprises a part of the silencer casing 16, for connecting the blower 10 to an associated apparatus or system (not shown), as will be hereinafter further discussed.

The impeller casing 14 defines a generally annular fluid chamber 22 (FIG. 3) the opposite end portions of which terminate at a fluid inlet opening 24 and a fluid outlet opening 26, respectively, formed in the partition wall 18 and opening into the silencer casing 16 as shown in FIG. 4.

A vaned impeller 30, supported for rotation within the impeller casing, defines a portion of the annular fluid chamber 22 which comprises a part of a fluid passageway through the casing, substantially as shown. The impeller 30 is driven by a motor 32 mounted on the impeller casing 14 immediately above the silencer casing 16. The illustrated silencer casing 16 defines a generally rectangular chamber 34 substantially filled with a resilient compressible acoustical material 36 a plastic foam material being presently preferred. A generally cylindrical fluid inlet passage way 38 formed in the acoustical material 36 communicates with the fluid inlet opening 24 and defines one terminal end of the fluid passageway through the casing. A generally cylindrical fluid outlet passageway 40 defined by the acoustic material 36 communicates with the fluid outlet opening 26 and defines the other terminal end of the fluid passageway.

The reversible connecting flange 20, hereinafter further discussed, provides a closure for the silencer casing 16 and includes inlet or suction and outlet or discharge conduit fittings which communicate, respectively, with the inlet passageway 38 and the outlet passageway 40 within the silencer casing 16 as will be hereinafter further described. For further disclosure for a blower of the type hereinbefore generally described, reference may be had to U.S. Pat. No. 4,412,781 to Abe et al., assigned to Hitachi, Ltd., Tokyo, JAPAN, which is hereby adopted by reference as part of the present disclosure.

Figure 5:
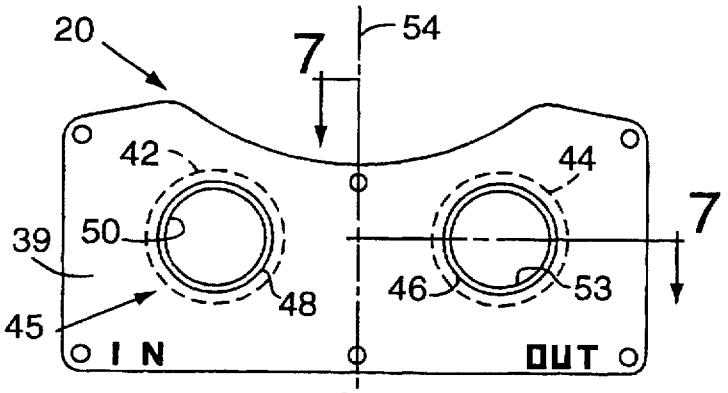
FIG. 5 is a somewhat enlarged elevational view of the reversible connecting flange.
Figure 6:
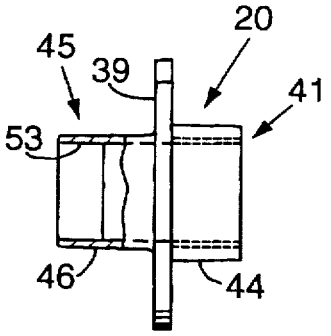
FIG. 6 is a side elevational view of the reversible connecting flange.
Figure 7:
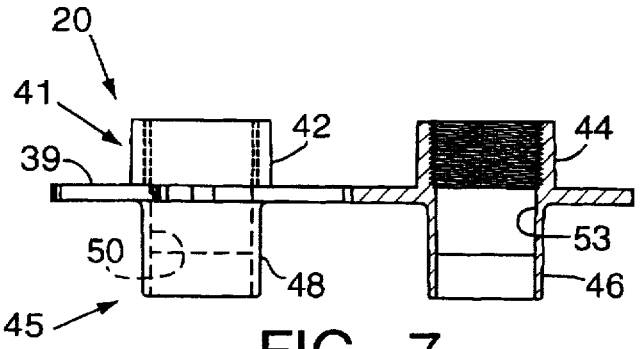
FIG. 7 is a top plan view of the reversible connecting flange shown partially in axial section taken generally along the line 7, 7 of FIG. 5.

Considering now the reversible connecting flange 20 in further detail and referring particularly to FIGS. 5–7, the presently preferred flange comprises a generally rectangular plate 39 having a first set of conduit fittings indicated generally at 41 which includes an inlet conduit fitting 42 and an outlet conduit fitting 44. The conduit fittings 42 and 44 are integrally connected to and project outwardly from one side of the plate 39 in axially normal relation to the plate. A second set of conduit fittings indicated generally at 45 include an inlet fitting 46 and an outlet fitting 48 which project from the opposite side of the plate 39 in axially normal relation to the plate. The inlet fitting 42 of the first set and the outlet fittings 48 of the second set have a common bore 50 which extends through the plate 39, as best shown in FIG. 7. In like manner the outlet fitting 44 of the first set and the inlet fitting 46 of the second set 45 also have a common bore 53 which extends through the plate 39.

The inlet and outlet fittings 42 and 44, which comprise the first pair 41 are substantially identical to each other. Each of the conduit fittings, 42 and 44 which comprise the first pair of fittings 41, is internally threaded for connection with an associated threaded pipe (not shown) which connects the blower 10 to an associated system.

The conduit fittings 46 and 48 which comprise the second set are also substantially identical to each other. However, each of the fittings 46 and 48 has a smooth outer surface for connection with a tubular conduit member or hose.

In accordance with presently preferred construction, the axial dimension of the tubular fittings 46 and 48 is somewhat greater than the axial dimension of the pipe fittings 42 and 44, as measured from an associated surface of the plate 39. It should also be noted that the reversible flange 20 is substantially symmetrical about a central vertical axis, the latter axis being indicated by the numeral 54 in FIG. 5. If desired, the words "In" and "Out" may be imprinted on the plate to designate the inlet and outlet ports, as shown in the drawings.

The reversible flange 20 is releasably secured in sealing engagement with the silencer casing 16 in a conventional manner by threaded fasteners and a suitable sealing gasket (not shown). In the drawing the reversible flange 20 is shown connected to the silencer casing 16 with the tubular fittings 46 and 48 exposed externally of the silencer casing for connection to flexible tubular conduit or hose employed in an associated system (not shown). The pipe fittings 42 and 44 are disposed within the silencer casing 16 in pressing engagement with the resilient compressible acoustical foam material 36 and in communication with the fluid inlet and outlet passageways 38 and 40, respectively, as best shown in FIG. 4.

If the blower 10 is to be connected to a system employing threaded pipe as the fluid conduit for the system the connecting flange 20 is removed from the blower and reconnected to it in a reverse position wherein the pipe fittings 42 and 44 are exposed externally of the silencer casing 16. In this reversed position of the flange the tubular conduit fittings 46 and 48 are disposed within the silencer casing 16 in pressing engagement with the acoustic material 36. Although the tubing or hose fittings 46 and 48 are of somewhat greater axial extent than the pipe fittings 42 and 44, the resilient compressible foam material 36 readily compensates for this difference in axial length to provide sealing engagement between the fittings and the acoustic material so that communication is established between the inlet and outlet passageways 38 and 40 formed in the acoustic material and the corresponding inlet and outlet ports 42 and 44 defined by the reversible flange 20. Thus, a single reversible flange enables the blower 10 to be adapted for connection to either threaded pipe or tubular conduit, or hose, as required.

I claim:

1. In a blower having a casing including means for defining a fluid passageway therethrough, a flange releasably secured to said casing and having port means defining an inlet port and an outlet port at opposite ends of said passageway, and an impeller supported for rotation within the casing for moving fluid in the passageway between the inlet port and the outlet port, the improvement comprising said flange being reversible relative to said casing and said port means including a first pair of conduit fittings projecting from one side of said flange and a second pair of conduit fittings projecting from another side of said flange opposite said one side, said first pair of fittings including a first inlet conduit fitting and a first outlet conduit fitting, said second pair of conduit fittings including a second inlet conduit fitting and a second outlet conduit fitting, each of said conduit fittings in said first pair being in fluid communication with an associated one of said conduit fittings in said second pair, said conduit fittings of said first pair being adapted for connection to one type of fluid conduit, said conduit fittings of said second pair being adapted for connection to another type of fluid conduit.

2. In a blower as set forth in claim 1 the further improvement wherein each of the conduit fittings in said first pair is coaxially aligned with an associated one of said conduit fittings in said second pair.

3. In a blower as set forth in claim 2 the further improvement wherein said first inlet conduit fitting and said second outlet conduit fitting have a common bore extending coaxially through said flange and said first outlet conduit fitting and said second inlet conduit fitting have a common bore extending coaxially through said flange.

4. In a blower as set forth in claim 3 the further improvement wherein said flange is generally symmetrical about an axis of symmetry passing through said flange between said fittings.

5. In a blower as set forth in claim 1 the further improvement wherein said flange includes a plate having parallel first and second sides and said fittings project from said sides in axially normal relation to said sides.

6. In a blower as set forth in claim 5 the further improvement wherein said flange is symmetrical about an axis of symmetry passing between the axes of said fittings.

7. In a blower as set forth in claim 1 wherein said one type of fluid conduit is threaded pipe the further improvement wherein said first pair of fluid conduit fittings comprise threaded fittings.

8. In a blower as set forth in claim 7 the further improvement wherein said threaded fittings are internally threaded.

9. In a blower as set forth in claim 1 wherein said another type of conduit is tubular conduit the further improvement wherein said second pair of fluid conduit fittings comprise tube fittings.

10. In a blower as set forth in claim 1 wherein said another type of conduit comprises hose the further improvement wherein said second fluid conduit fittings comprise hose fittings.

11. In a regenerative blower having a casing including means for defining a fluid passageway therein, a flange releasably secured to said casing and having connecting means defining a suction port and a discharge port for communicating with the fluid passageway, and an impeller supported for rotation within the casing for moving fluid in the passageway between the suction port and the discharge port, the improvement comprising said flange being reversible relative to said casing and said connecting means including a first set of fluid conduit fittings projecting from one side of said flange and a second set of fluid conduit fittings projecting from the side of said flange opposite said one side, said first set of fluid conduit fittings including a first inlet conduit fitting and a first outlet conduit fitting, said second set of fluid conduit fittings including a second inlet conduit fitting and a second outlet conduit fitting, each of said conduit fittings in said first set being in fluid communication with an associated one of said conduit fittings in said seconds set, said fluid conduit fittings in said first set being adapted for connection to one type of fluid conduit, said fluid conduit fittings in said second set being adapted for connection to another type of fluid conduit, one of the sets of fluid conduit fittings being exposed externally of the casing, the other of the sets of fluid conduit fittings communicating with said fluid passageway within said casing.

12. In a regenerative blower as set forth in claim 11 wherein said casing comprises a casing assembly including an impeller casing and a silencer casing, the further improvement wherein said flange comprises a closure for said silencer casing and said other of the sets is disposed within said silencer casing.

13. In a regenerative blower as set forth in claim 12 wherein said silencer contains acoustic material defining portions of said passageway.

14. In a regenerative blower as set forth in claim 13 wherein said acoustic material defines terminal end portions of said passageway and each of the fluid conduit fittings of said other of the sets communicates with an associated one of said terminal end portions.

15. In a regenerative blower as set forth in claim 14 the further improvement wherein said acoustic material comprises a resilient compressible material and each of the fluid conduit fittings of said other of the sets is disposed in pressing engagement with said acoustic material.

* * * * *